US008297446B2

(12) United States Patent
Spence, Jr.

(10) Patent No.: US 8,297,446 B2
(45) Date of Patent: Oct. 30, 2012

(54) APPARATUS AND METHOD FOR SORTING AMMUNITION CASINGS

(76) Inventor: James W. Spence, Jr., Calumet, MI (US)

( * ) Notice: Subject to any disclaimer, the term of this patent is extended or adjusted under 35 U.S.C. 154(b) by 83 days.

(21) Appl. No.: 12/836,956

(22) Filed: Jul. 15, 2010

(65) Prior Publication Data

US 2012/0012509 A1 Jan. 19, 2012

(51) Int. Cl.
*B07C 5/04* (2006.01)

(52) U.S. Cl. ..... 209/679; 209/675; 209/682; 209/911; 209/920

(58) Field of Classification Search ..... 209/675–679, 209/682, 910, 911, 920
See application file for complete search history.

(56) References Cited

U.S. PATENT DOCUMENTS

| | | | | |
|---|---|---|---|---|
| 377,667 | A * | 2/1888 | Chadwick | 209/629 |
| 465,856 | A * | 12/1891 | Hutchins | 209/663 |
| 581,321 | A * | 4/1897 | Wilson | 209/678 |
| 1,189,167 | A * | 6/1916 | Parker | 209/625 |
| 2,295,190 | A * | 9/1942 | Zenge | 209/674 |
| 2,422,036 | A * | 6/1947 | Oakley | 209/555 |
| 4,261,377 | A | 4/1981 | Ueda | |
| 4,804,093 | A * | 2/1989 | Durow | 209/691 |
| 4,923,066 | A | 5/1990 | Ophir et al. | |
| 5,052,167 | A | 10/1991 | Scharch | |
| 6,173,841 | B1 | 1/2001 | Yanagimoto et al. | |
| 6,360,895 | B1 | 3/2002 | Riggenmann et al. | |
| 2003/0057137 | A1 | 3/2003 | Wojtecki et al. | |
| 2005/0226489 | A1 | 10/2005 | Beach et al. | |
| 2011/0174702 | A1 * | 7/2011 | Fisher | 209/683 |

FOREIGN PATENT DOCUMENTS

| | | | |
|---|---|---|---|
| EP | 405943 | A1 * | 1/1991 |
| JP | 03143820 | A * | 6/1991 |

OTHER PUBLICATIONS www.shellsorter.com/Whatisit/what is it.html, Jul. 15, 2010, pp. 1-4.

* cited by examiner

*Primary Examiner* — Joseph C Rodriguez
(74) *Attorney, Agent, or Firm* — Brooks Kushman P.C.

(57) ABSTRACT

An apparatus and method for sorting ammunition casings and adapted to be mounted on a vibrating base. The apparatus includes an input hopper adapted to receive ammunition casings and a sorting track in communication with the input hopper where the sorting tracks has a graduated opening the bottom of the track such that the diameter of the graduated opening increases as the opening extends away from the hopper. The apparatus further includes sorting compartments arranged under the sorting track. Vibration moves the casings from the input hopper to the sorting track, and as the casings move along the sorting track, smaller diameter casings fall through a first opening portion into a first sorting compartment, and larger diameter casings move along the sorting track past the first opening portion and subsequently fall though a second opening portion into a second sorting compartment thereby separating the ammunition into different calibers.

18 Claims, 5 Drawing Sheets

APPARATUS AND METHOD FOR SORTING AMMUNITION CASINGS

TECHNICAL FIELD

The present invention relates to an apparatus and method for sorting spent ammunition shells and casings.

BACKGROUND

In modern firearms, "caliber" is the approximate inner diameter of the barrel and the corresponding diameter of the ammunition or projectile used in the firearm, measured in inches or millimeters. When the barrel diameter is given in inches, the abbreviation "caliber" is used in place of "inches." For example, a small bore rifle with a diameter of 0.22 inch is a .22 cal. When spoken, however, the decimal point is generally dropped and is referred to as "twenty-two caliber". Calibers of weapons can be referred to in millimeters, for examples "nine millimeter," or abbreviated as 9 mm. Further, loaded or live ammunition is generally referred to as "cartridges," while "casings" or "shells" generally refer to the spent ammunition cartridges.

While modern cartridges and cartridge firearms are generally referred to by caliber, they are still grouped together based on bore diameter. In small arms, such as handguns and rifles, even different caliber casings from many firearms are very close in size. Once the bullet has been fired, the generally hollow brass cylinders of the casings or shells are ejected and discarded from the firearm, and may then be recovered and reused. When the spent cartridges or casings are mixed together in large quantities, such as after sweeping up at a firing range, these mixed shells may be difficult and time consuming to sort because of their close similarities, both in appearance and diameter. However, the casings and shells must be separated by caliber before they can be cleaned, reloaded or packaged for resale. Mixed quantities of empty casings or shells must be sorted by hand, a tedious and time-consuming process.

In preparation of this application, prior art was examined. For example, U.S. Patent Application Publication US2005/0226489 discloses a machine vision system for identifying and sorting projectiles and other objects. Another reference, U.S. Patent Application Publication US2003/0057137 is directed to a cartridge sorting machine which separates live ammunition from spent cartridges.

SUMMARY

The present invention provides a method and apparatus to easily allow sorting of a collection of mixed caliber ammunition spent shells and casings. The apparatus and method may sort five or more different calibers of spent shells at one time where each different caliber has a different length and diameter. Furthermore, the present invention allows for the spent shells to be sorted even if they are dirty and caliber markings are thus difficult to read while sorting.

An aspect of the present invention provides for an apparatus for sorting ammunition casings. The apparatus is adapted to be mounted on a vibrating base. The apparatus includes an input hopper adapted to receive ammunition casings and at least one sorting track in communication with the input hopper. The sorting track has a graduated opening defined along at least a section of a bottom of the track such that the diameter of the graduated opening increases as the opening extends away from the hopper. The apparatus further includes a plurality of sorting compartments arranged under the sorting track. Vibrations move the ammunition casings from the input hopper to the sorting track. As the casings move along the sorting track, smaller diameter casings fall through a first opening portion of the graduated opening into a first sorting compartment. Larger diameter casings move along the sorting track past the first opening portion of the graduated opening and subsequently fall though a second opening portion into a second sorting compartment thereby separating the ammunition casings into different calibers.

A further aspect of the present invention provides for an apparatus for sorting ammunition casings with a sorting manifold. The sorting manifold includes an input hopper adapted to receive ammunition casings and at least one linear sorting track in communication with the input hopper. The sorting track has a stepped slot defined along the bottom of the track such that the diameter of the slot increases in step increments as the slot extends away from the hopper. The sorting apparatus also includes a base assembly adapted to be mounted to a vibrating base. The base assembly includes a plurality of exhaust chutes. The exhaust chutes are in communication and aligned with the stepped slot when the sorting manifold is mounted to the base assembly. Vibrations from a vibrating base move the ammunition casings from the input hopper to the sorting track. As the casings move along the sorting track, small diameter casings fall through a first stepped increment portion of the stepped slot into a first exhaust chute. Larger diameter casings move along the sorting track past the first stepped increment portion and subsequently fall though a second stepped increment portion in the slot into a second exhaust chute thereby separating the ammunition casings into different calibers.

A further aspect of the prevention provides a method for sorting ammunition casings. The method includes the steps of providing a hopper mounted on a vibrating base, then communicating at least one sorting track with the input hopper, the sorting track having one or more graduated openings defined along at least a section thereof, a diameter of the one or more graduated openings increasing with distance from the hopper. Next, a plurality of sorting compartments is arranged in communication with the sorting track. The sorting compartments receive the ammunition casings so that similar calibers will be accommodated in the same compartments. Finally, the base is vibrated so that the base and the hopper influence the sorting track thereby influencing transition of the ammunition casings from the input hopper to the one or more compartments through graduated movement of the ammunition casings.

BRIEF DESCRIPTION OF THE DRAWINGS

The present invention is pointed out with particularity in the appended claims. However, other features of the present invention will become more apparent, and the present invention will be best understood by referring to the following detailed description in which:

DETAILED DESCRIPTION

Reference will now be made in detail to presently preferred components, embodiments and methods of the present invention, which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details and embodiments of the invention disclosed herein are not to be interpreted as limiting, but merely as a representative basis for any aspect of the invention and/or as a representative basis for teaching one skilled in the art to variously employ the present invention.

Except in the examples, or where otherwise expressly indicated, all numerical quantities in this description indicating dimensions are to be understood as modified by the word "about" in describing the broadest scope of the invention. Practice within the numerical limits stated is generally preferred. The first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property. Further, the features of various implementing embodiments may be combined to form further embodiments of the invention.

Figure 1:
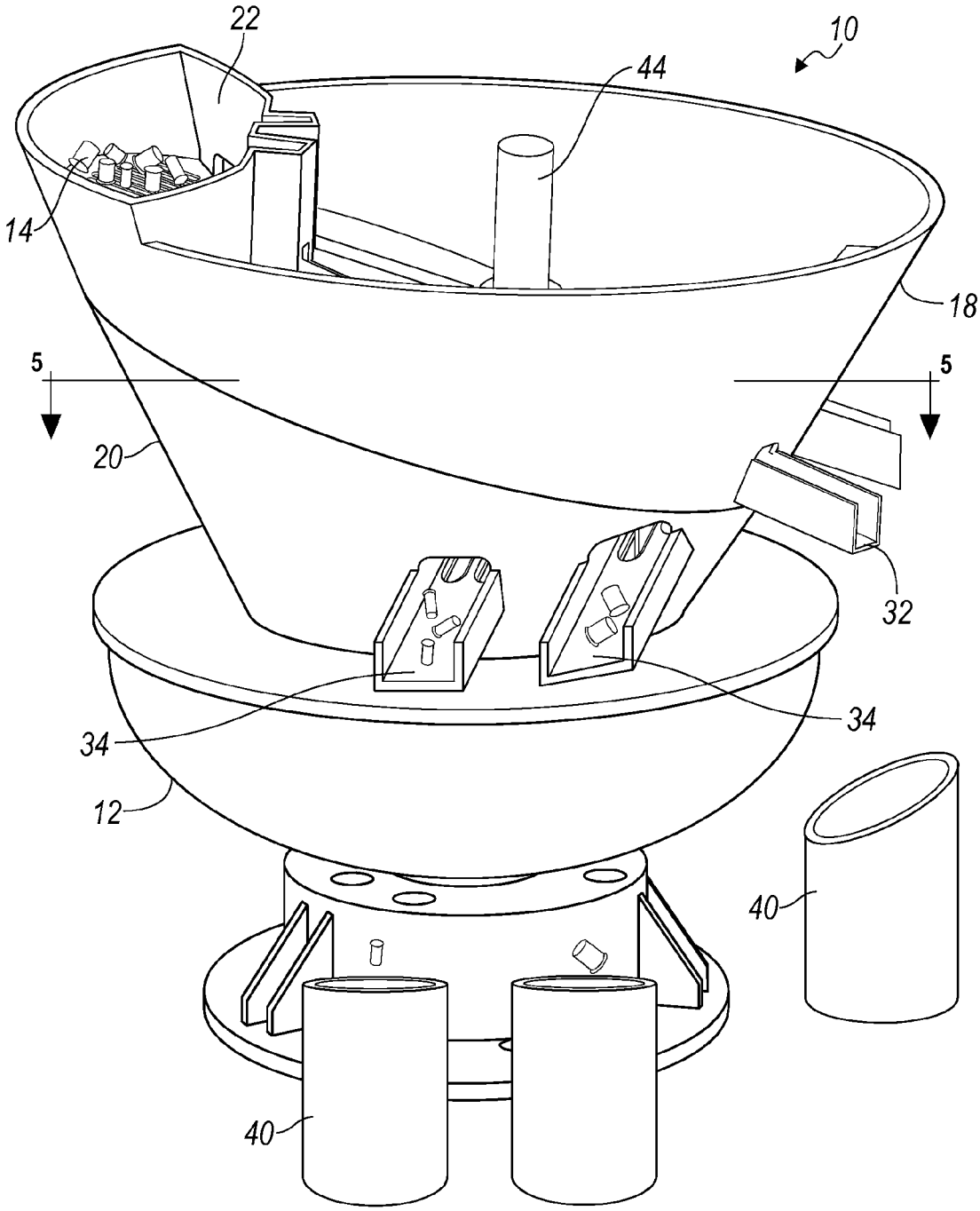
FIG. 1 illustrates a perspective view of an ammunition sorter according to one aspect of the present invention.

FIG. 1 illustrates an ammunition sorter 10 according to an aspect of the present invention. The ammunition sorter 10 uses vibrating motion to agitate and move the mixed casings along a sorting chute causing them to flow through the sorter 10 and be separated by size or caliber. As such, the ammunition sorter 10 may be mounted on a vibrating base. Brass tumblers or vibratory case cleaners, generally called tumblers 12, are commercially available and are used for cleaning and polishing spent casings and shells 14 using abrasive media and/or vibratory motion. As such, the ammunition sorter 10 may be adapted to mount on a brass tumbler or vibratory cleaner 12 used in ammunition hand loading to use the vibration of the tumbler 12 in the ammunition sorter 10. The brass tumblers which are commercially available may have a bowl mounted on a motorized base 12.

While the present invention is described as mounted on a brass tumbler or vibratory cleaner 12, it is also contemplated that the ammunition sorter 10 may be mounted on any motorized vibrating base 12 or apparatus which provides vibration to the ammunition sorter 10.

The ammunition sorter 10 may be comprised of two separate parts for ease of manufacturing. The ammunition sorter 10 may include a sorting manifold 18 and a lower base assembly 20 which are manufactured separately and connected together to form the ammunition sorter 10. The sorting manifold 18 and base assembly 20 may be injection molded or manufactured by any other conventional method.

Figure 2:
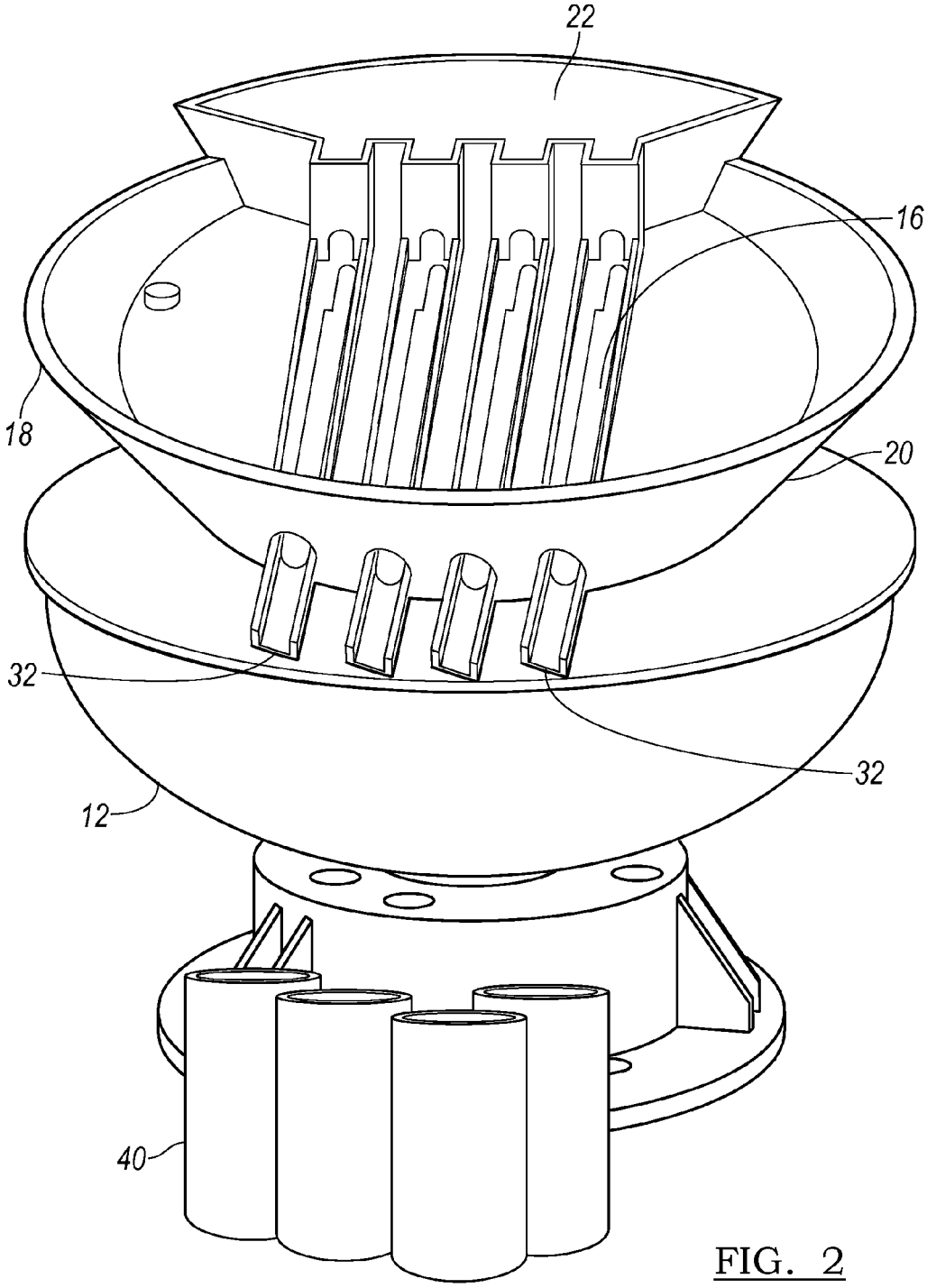
FIG. 2 illustrates a perspective view of an alternate configuration of the ammunition sorter according to an aspect of the present invention.

By manufacturing the ammunition sorter 10 as two separate components, the sorting manifold 18 may be interchanged for higher capacity sorting. For example, the sorting manifold 18 may include two sorting tracks 16, as illustrated in FIG. 1. Furthermore, the sorting manifold 18 may have a plurality of sorting tracks 16 such as four or more sorting tracks aligned in parallel, as illustrated in FIG. 2. Additional configurations of sorting manifolds 18 may be employed, depending on quantity of casings 14 to be sorted, and size of the vibratory base 12.

Figure 3:
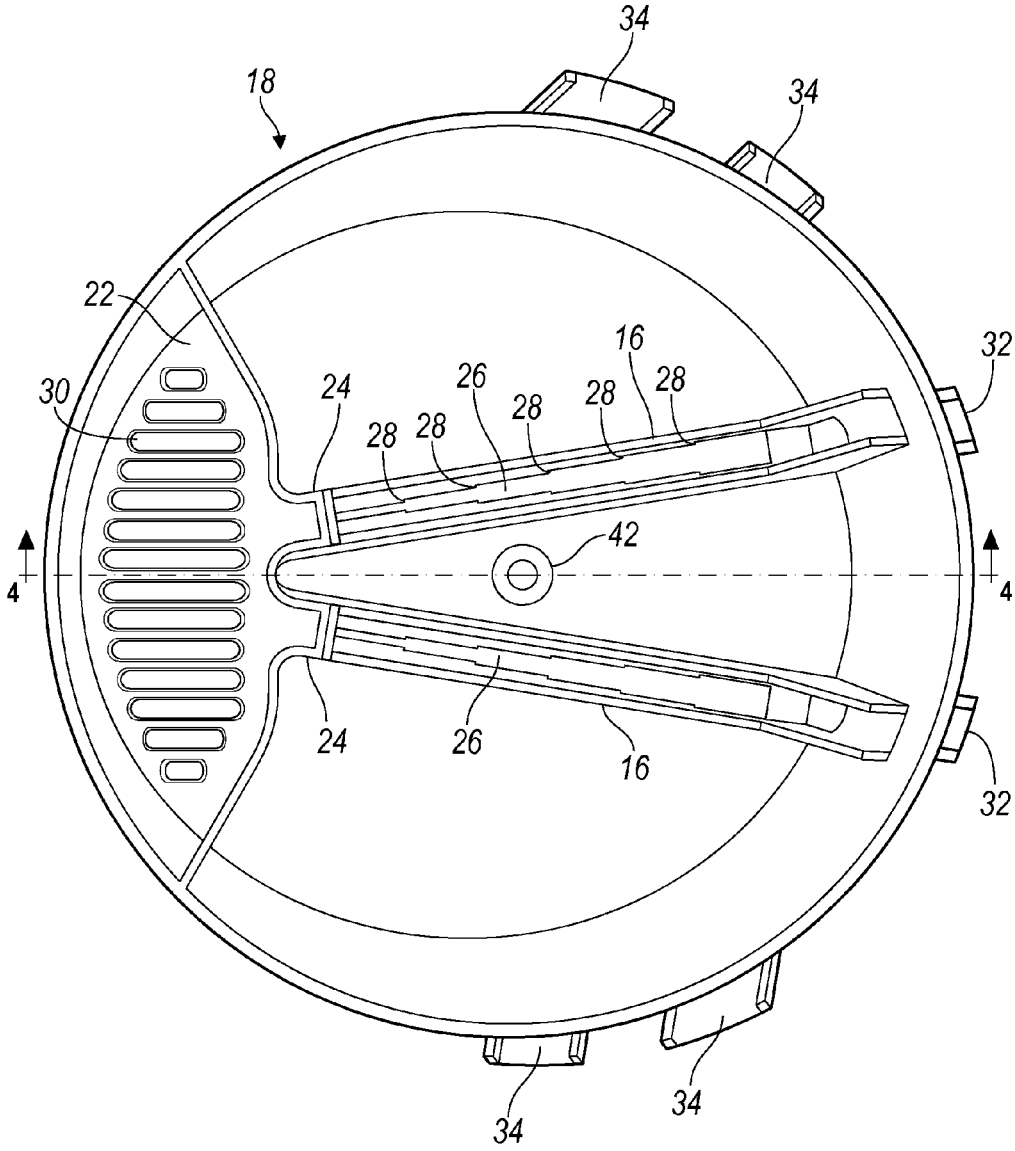
FIG. 3 is a top view of the ammunition sorter according to an aspect of the present invention.

Referring now to FIG. 3, FIG. 3 illustrates a top view of the ammunition sorter 10 according to an aspect of the present invention. The top view of the ammunition sorter 10 illustrates in more detail the input hopper 22 and the sorting tracks 16 that separate the spent shells and casings 14 as they move down the sorting tracks 16 in a linear flow pattern.

An input hopper 22 may be provided for receiving a collection of mixed caliber ammunition casings 14. The input hopper 22 may be located along one side of the sorting manifold 18 and may be shaped to funnel the casings 14 to the entrance of the sorting tracks to ensure sufficient flow of the casings into the sorting tracks 16. Additionally, the input hopper 22 may be connected to the sorting track 16 the by a mouth opening 24 which may route the shells 14 towards the sorting track 16. Advantageously, it is contemplated that the shells 14 do not need to oriented in a particular direction or configuration before entering the sorting track 16.

The ammunition sorter 10 may include at least one sorting track 16 in communication with the input hopper 22 and the brass casings or shells 14 may enter the sorting tracks 16 through the opening formed in a side of the input hopper 22. The sorting track 16 may be a linear track with a generally U-shaped channel having a graduated opening 26 formed in the bottom of the track 16. The sorting track 16 may have a width slightly wider than the diameter of the largest shell. In one embodiment, the width of the sorting track 16 may be 0.525 inches wide.

As illustrated in FIG. 1, the sorting track 16 may be inclined so that the shells 14 also move from the input hopper 22 into the sorting tracks under gravitational force. The sorting tracks may be inclined from 15 degrees to 45 degrees to aid the flow of the casings into the sorting tracks. It is also contemplated that the sorting track 16 may have a lesser angle of incline or a larger angle of incline depending on the configuration and magnitude of vibration provided. With greater vibration, the angle of the sorting track may 15 degrees or less.

The graduated opening 26 in the sorting track 16 may have a diameter that increases as the opening extends away from the input hopper 22. As vibrations from the vibrating base move the ammunition shells 14 from the input hopper 22 to the sorting track 16, the graduated opening 26 may have a first opening portion 28 that allows small diameter shells to fall through, and a second portion 28 which allows larger ammunition shells to fall through.

Alternatively, the graduated opening may be a stepped slot 26 defined along the bottom of the track 16, such that the diameter of the slot 26 increases in step increments 28 as the slot 26 extends away from the hopper 22. While the graduated opening or slot 26 is illustrated as a step-profile, the profile of the graduated opening or slot 26 may further have a wave profile, a elongated slit opening with increasing diameter or another geometric configuration which allows the diameter of the slot 26 to increase as it extends away from the input hopper 22.

The width of the incremental slot portions 28 may be based on common-sized casings. Further, the width of the incremental slot portions 28 may increase in diameter as the graduated opening 26 extends away from the input hopper 22 towards the distal end 32 of the sorting track 16.

In one embodiment of the present invention, the stepped slot 26 in the sorting track 16 may have five stepped increment portions 28 defined in the bottom of the sorting track 16. Due to close tolerances of the numerous different shell diameters, the stepped increment portions 28 of the sorting track 16 may be designed to separate out the most popular calibers, such as 9 millimeter .40 Smith & Wesson, .45 ACP and .50 caliber handgun casings.

In another embodiment of the present invention, at least one of the increment portions 28 may have small notches (not pictured) of increased diameter in order to sort rimmed revolver casings of approximately the same diameters. Other casings which are close in diameter may be grouped with these major calibers.

The notches will only extend along a section of the increment portion 28, so as to allow casings with a rim to fall through, and prevent larger shells from falling through in the increment portion with the notch. In a further embodiment of the present invention, at least two of the step increment portions 28 may have small notches in order to accommodate other rimmed revolver cartridges such as .38 special, .357 Magnum, .44 Special and .44 Magnum casings, for example.

It is contemplated that the increment portion 28 with a notch may have at least two notches where one notch is located at the beginning of the section, and another notch is located at the end of the section, so that the rimmed casings will be sorted independent of their orientation.

Additionally, the input hopper 22 may have filter openings 30 defined in the input hopper 22. The filter openings 30 may be formed in the bottom of the input hopper 22 to allow very small shells and debris to fall through before entering the sorting track 16. Further, the first stepped increment portion 28 of the slot may be the same size as the filter openings 30. The filter opening 30 may filter small, non-reloadable casings, such as .22 caliber shells, and debris for disposal or recycling.

The sorting tracks may have an open distal end 32 which forms an exhaust chute. The exhaust chute portion 32 may lack an slot 26 along the bottom so that large caliber casings which are larger than the largest incremental step portion 28 do not fall through the graduated opening 26, and are moved to a location outside the sorting track 16 when the casings exit the exhaust chute 32. Shells which fall through the sorting track 16 may also exit the ammunition sorter 10 through exhaust chutes 34 located in the base assembly 20.

The following chart shows an example of the diameter of the sorting track 16 increment portions 28, and the type and caliber of shells 14 that may be sorted in each portion 28.

| Slot portion | Slot width (inches) | Caliber Casings Sorted by Slot portion |
|---|---|---|
| Filter | 0.300 | debris<br>non-reloadable shells |
| 1st | 0.385 | .30 Carbine<br>.38 Automatic<br>0.32 Smith & Wesson<br>0.357/.38 |
| 2nd | 0.415 | 9 mm<br>.223 Remington<br>.38 Super |
| 3rd | 0.440 | .40 Smith & Wesson<br>10 mm |
| 4th | 0.495 | .44 Mag<br>7.62 NATO<br>.45 ACP |
| 5th | Exhaust Chute | .454 Casull<br>.50 AE |

For example, in operation, debris and casings smaller than 0.300 inches could fall through the filter openings 30. Subsequently, shells smaller than 0.385 inches would fall through the first stepped slot portion 26, such as .30 Carbine shells. Next, casings smaller than 0.415 inches would fall through the second stepped slot portion 26, such as 9 mm shells, for example. Then, shells smaller than 0.440 inches would fall through the third incremental slot portion 26, and shells smaller than 0.495 inches would fall though the fourth stepped slot portion 26. Any cartridges larger than 0.495 inches would continue along the sorting track 16 and exit the sorting manifold 18 through the exhaust chute 32. It is further contemplated that the diameter of the slot portions 26 may have different widths in order to group or sort shells in different categories or groupings.

Figure 4:
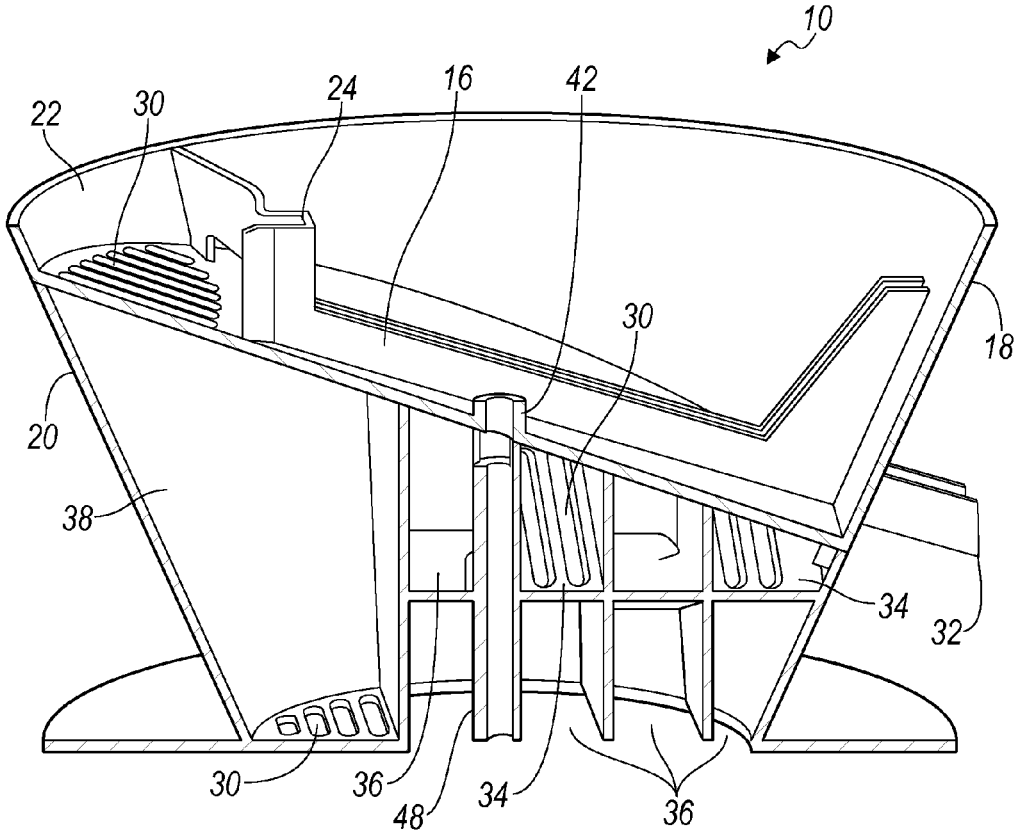
FIG. 4 is a side section view of the ammunition sorter along section 4-4 from FIG. 3 according to an aspect of the present invention.

Referring now to FIG. 4, a side section view from section 4-4 in FIG. 3 is illustrated. In particular, FIG. 4 illustrates a section view of base assembly 20 including sorting compartments 36 and exhaust chutes 34. The stepped-increment width portions 28 of the sorting track 16 are positioned over corresponding sorting compartments 36 located below in the base assembly 20.

The side section view in FIG. 3 illustrates the compartments 36 located below the sorting track 16 through which the brass casings 14 drain when they fall through the graduated opening 26. A first sorting compartment 38 may be located under the filter openings 30 defined in the input hopper 22 through which small casings and debris may fall. The first increment portion 28 of the graduated opening 26 may also be in communication with and connected to the first sorting compartment 38.

The graduated opening 26 may have a second opening portion 28 through which larger casings may fall into a second sorting compartment 36. It is further contemplated that the base assembly 20 may have additional sorting compartments 36 which correspond to additional step-increment portions 28 in the slot 26 defined in the sorting track 16. Once the casings fall through the graduated opening 26 into a sorting compartment 36, the casings may be stored in the compartments 36 until the sorting process is completed.

It is also contemplated that the sorting compartments 36 may include exhaust chutes 34 which move the shells to a location outside the sorting compartments 36. The exhaust chutes 34 may be disposed in the sorting compartment 36 such that the exhaust chute 34 corresponds to a portion 28 of the sorting track 16 so that when the shells slide down the track 16 and drop through the stepped slot 26 into compartments 36, the casings will slide out the exhaust chutes 34 into containers 40 located outside the ammunition sorter 10 thereby separating the ammunition casings into different calibers.

As further illustrated in the side section view in FIG. 3, the exhaust chutes 34 may have alternating sloped floors in alternating sorting compartments 36. In this cutaway view, only two of the exhaust chutes 34 with alternating sloped floors can be shown, for example in the third and fifth sorting compartments 36. The alternating slopes of the exhaust chutes 34 allow different sized cartridges to drain to containers 40 on opposite sides of the ammunition sorter 10.

Figure 5:
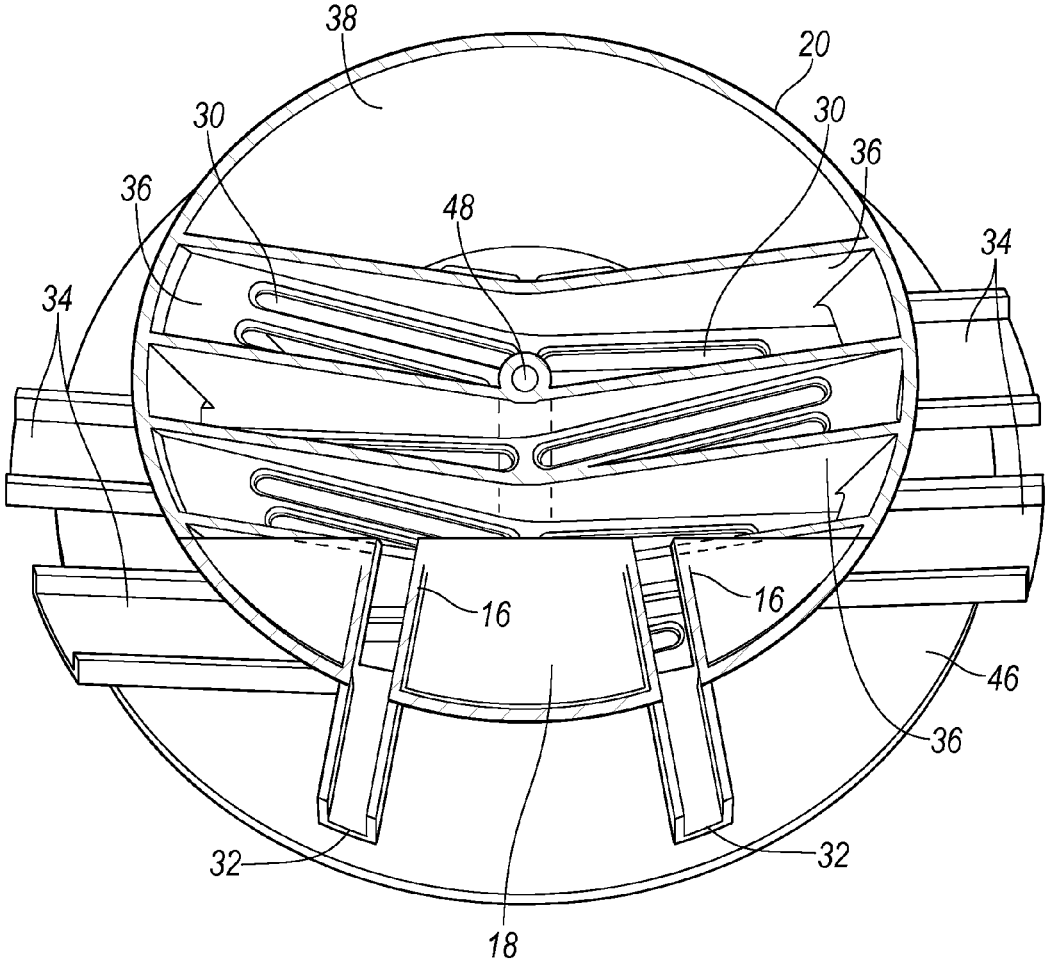
FIG. 5 is a top section view of the ammunition sorter along section 5-5 from FIG. 1 according to an aspect of the present invention.

Referring now to FIG. 5, FIG. 5 illustrates a horizontal cross section of the ammunition sorter 10 taken along section 5-5 from FIG. 1. FIG. 5 further illustrates the sorting compartments 36 and exhaust chutes 34 with alternating sloped floors which allow the casings and shells to slide toward respective exhaust chutes 34.

As illustrated, the base assembly 20 includes four exhaust chutes 34, where two exhaust chutes 34 are located on a first side of the base assembly 20, and two additional exhaust chutes 34 exit the base assembly 20 on a second side. It is further contemplated that the exhaust chutes may be disposed 34 in any pattern to accommodate various container 40 configurations or space. In the illustrated embodiment of the present invention, the second and fourth exhaust chutes 34 exit the base assembly 20 on a first side, and the third and fifth exhaust chutes 34 are located along a second side of the base assembly The exhaust chutes 34 may also have filter openings 30 defined in the floor of the chutes 34 which allows all small casings and debris to fall through into a first compartment 38. Alternatively, the first compartment 38 and the base of the base assembly 20 may have openings to allow the small casings and debris to fall through into the tumbler bowl 12 for disposal. It is also contemplated that the first compartment 38 may also include an exhaust chute 34.

Turning back to FIG. 1, the ammunition sorter 10 may be mounted on the vibrating base 12 through a center opening 42 defined in the ammunition sorter 10. The center opening 42 may be a threaded opening. The tumbler or vibratory cleaner 12 may have a threaded center aperture or post 44 located in the center of the bowl which extends vertically upward and protrudes from the bowl. The ammunition sorter 10 may be mounted and connected to the brass tumbler 12 along the threaded center post 44 with a threaded shaft or bolt 44 which extends through the center opening 42,48 and engages the threaded post which may protrude vertically from the vibrating base 12.

As further shown in FIG. 3, the ammunition sorter 10 may be attached to the vibrating base through the center opening 42. The center opening 42 may extend through the center of the sorting manifold 18 and also connect through an elongated opening 48 in the base assembly 20. However, it is further contemplated that the ammunition sorter 10 may be attached to the vibrating base 12 through alternate attachment mechanisms, such as through a latch or connection on the base plate 46, for example.

The base plate 46 may further be weighted to accommodate different vibratory bases 20 in order to ensure optimal vibration influence to the ammunition sorter 10. In addition, the base plate 46 may have openings that allow some shells or debris to fall through to the vibratory tumbler bowl 12. Further, the base plate 46, as well as the ammunition sorter 10, may be generally circular to correspond to the bowl of commercially available brass tumblers 12. However, the base plate 46, and the ammunition sorter 10 may be another configuration. The base plate 46 may be integrally formed or molded as one piece with the base assembly 10, or the base plate 46 may be attached separately.

The diameter of the ammunition sorter 10 may be approximately 13 inches and the ammunition sorter 10 may have a height of about 6 inches. However, this may be modified to fit larger volume tumblers or cleaners or different vibratory bases 12.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for sorting ammunition casings and adapted to be mounted on a vibrating base, the apparatus comprising:

an input hopper adapted to receive ammunition casings;

at least one sorting track in communication with the input hopper, at least some of the at least one sorting track having a graduated opening with a rectangular step-profile precisely defined along at least a section of a bottom of the track such that the diameter of the graduated opening increases as the opening extends away from the hopper; and a plurality of sorting compartments arranged under the at least one sorting track, wherein vibrations generated by the vibrating base move the ammunition casings from the input hopper to the at least one sorting track, and as the casings move along the at least one sorting track, smaller diameter casings fall through a first rectangular opening portion of the graduated opening into a first sorting compartment, and larger diameter casings move along the at least one sorting track past the first rectangular opening portion of the graduated opening and subsequently fall though a second rectangular opening portion into a second sorting compartment, wherein the first and second rectangular openings are precisely sized to separate the ammunition casings into different calibers;

a plurality of exhaust chutes corresponding to and disposed in the plurality of sorting compartments wherein the exhaust chutes include filter openings defined along the bottom of the exhaust chute, the filter openings being the same diameter as the first opening portion so that small caliber casings fall through the filter openings into the first sorting compartment.

2. The apparatus according to claim 1 wherein the width of the first and second rectangular opening portions increases in step increments as the graduated opening extends away from the input hopper, wherein a width variation between first and second rectangular opening portions is less than 0.1 inches in order to accurately sort the different caliber casings.

3. The apparatus according to claim 2 wherein the width variation between adjacent step-increments is generally between 0.02 inches and 0.05 inches in order to accurately sort the different caliber casings.

4. The apparatus according to claim 2 wherein a width of the first and second rectangular opening portions is generally between 0.3 inches and 0.6 inches.

5. The apparatus according to claim 1 wherein the input hopper further includes filter openings defined in the hopper through which small caliber casings and debris fall through into a sorting compartment.

6. The apparatus according to claim 5 wherein the filter openings have the same diameter as the first opening portion of the graduated opening, the filter openings and the first opening portion both being in communication with the first sorting compartment.

7. The apparatus according to claim 5 wherein the filter openings have the same diameter as the first opening portion of the graduated opening, the filter openings and the first opening portion both in communication with the first sorting compartment.

8. The apparatus according to claim 1 wherein a distal end of the at least one sorting track lacks an opening along the bottom and has an opening at the end so that large caliber casings do not fall through the graduated opening and are moved to a location outside the at least one sorting track.

9. An apparatus for sorting ammunition casings and adapted to be mounted on a vibrating base, the apparatus comprising:

an injection molded sorting manifold formed of one-piece, the sorting manifold molded to integrally include:

an input hopper adapted to receive ammunition casings;

at least one linear sorting track in communication with the input hopper, at least some of the one or more sorting tracks having a stepped slot defined along the bottom of the track such that the diameter of the slot increases in step increments as the slot extends away from the hopper; and an injection molded base assembly formed of one-piece adapted to fit together with the sorting manifold and to be mounted to a vibrating base, the base assembly molded to integrally include a plurality of exhaust chutes in communication and aligned with the stepped slot when the sorting manifold is mounted to the base assembly, wherein vibrations from a vibrating base move the ammunition casings from the input hopper to the at least one sorting track, and as the casings move along the at least one sorting track, small diameter casings fall through a first stepped increment portion of the stepped slot into a first exhaust chute, and larger diameter casings move along the sorting track past the first stepped increment portion and subsequently fall though a second stepped increment portion in the slot into a second exhaust chute t wherein the first and second step increment portions are precisely sized to separate separating the ammunition casings into different calibers.

10. The apparatus according to claim 9 wherein the slot includes at least three incremental step portions in order to sort the casings into at least three different caliber sizes, wherein a width variation between the adjacent increment portions is less than 0.05 inches in order to accurately sort the different caliber casings.

11. The apparatus according to claim 10 wherein the width variation between adjacent step increment portions is generally between 0.02 inches and 0.05 inches in order to accurately sort the different caliber casings.

12. The apparatus according to claim 10 wherein a width of the step increment portions is generally between 0.3 inches and 0.5 inches.

13. The apparatus according to claim 9 wherein the sorting track has an open distal end such that casings that are larger than the largest incremental step portion of the slot pass through the distal end and are deposited to a location outside the manifold and base assembly thereby sorting the casings into at least three different caliber sizes.

14. The apparatus according to claim 9 wherein the vibrating base is a brass tumbler, the base assembly having an aperture adapted to align with and connect to a threaded post on the vibrating base.

15. The apparatus according to claim 9 wherein the base assembly further includes at least one sorting compartment such that casings from the manifold are deposited in the sorting compartment.

16. The apparatus according to claim 9 wherein the input hopper includes filter openings defined in the bottom of the hopper, and wherein the exhaust chutes further include filter openings defined along the bottom of the exhaust chutes, the filter openings being the same diameter as the filter openings in the input hopper so that small diameter casings and debris fall through the filter openings into a sorting compartment.

17. The apparatus according to claim 9 wherein there are a plurality of sorting tracks, each sorting track having a corresponding stepped slot defined by rectangular openings that are precisely sized to separate the ammunition casings into different calibers.

18. An apparatus for sorting ammunition casings and adapted to be mounted on a vibrating base, the apparatus comprising:

an input hopper adapted to receive ammunition casings;

at least one sorting track in communication with the input hopper, at least some of the at least one sorting track having a graduated opening defined along at least a section of a bottom of the track such that the diameter of the graduated opening increases as the opening extends away from the hopper;

a plurality of sorting compartments arranged under the at least one sorting track, wherein vibrations move the ammunition casings from the input hopper to the at least one sorting track, and as the casings move along the at least one sorting track, smaller diameter casings fall through a first opening portion of the graduated opening into a first sorting compartment, and larger diameter casings move along the at least one sorting track past the first opening portion of the graduated opening and subsequently fall though a second opening portion into a second sorting compartment thereby separating the ammunition casings into different calibers; and a plurality of exhaust chutes corresponding to and disposed in the plurality of sorting compartments wherein the exhaust chutes include filter openings defined along the bottom of the exhaust chute, the filter openings being the same diameter as the first opening portion so that small caliber casings fall through the filter openings into the first sorting compartment.

* * * * *

UNITED STATES PATENT AND TRADEMARK OFFICE

CERTIFICATE OF CORRECTION

PATENT NO. : 8,297,446 B2
APPLICATION NO. : 12/836956
DATED : October 30, 2012
INVENTOR(S) : James W. Spence, Jr.

It is certified that error appears in the above-identified patent and that said Letters Patent is hereby corrected as shown below:

Column 9, Line 21, Claim 9

Before "wherein"
Delete "t"

Column 9, Line 22, Claim 9

After "sized to separate"
Delete "separating"

Signed and Sealed this
Twenty-sixth Day of March, 2013

Teresa Stanek Rea
*Acting Director of the United States Patent and Trademark Office*